US005441425A

United States Patent [19]

Kitamura

[11] Patent Number: 5,441,425

[45] Date of Patent: Aug. 15, 1995

[54] ELECTRICAL CONNECTOR WITH THROUGH CONDENSER

[75] Inventor: Hiroshi Kitamura, Kawasaki, Japan

[73] Assignee: The Whitaker Corporation, Wilmington, Del.

[21] Appl. No.: 84,671

[22] Filed: Jun. 29, 1993

[30] Foreign Application Priority Data

Jul. 7, 1992 [JP] Japan ..... 4-053131 U
Jul. 13, 1992 [JP] Japan ..... 4-207049

[51] Int. Cl.[6] ..... H01R 13/66
[52] U.S. Cl. ..... 439/620; 439/607
[58] Field of Search ..... 439/620, 607-610

[56] References Cited

U.S. PATENT DOCUMENTS 4,784,618 11/1988 Sakamoto et al. ..... 439/620
4,995,834 2/1991 Hasegawa ..... 439/620
5,006,079 4/1991 Okamoto et al. ..... 439/620
5,018,990 5/1991 Sakamoto et al. ..... 439/620
5,219,305 6/1993 Kawaguchi et al. ..... 439/620
5,316,501 5/1994 Mair ..... 439/609

FOREIGN PATENT DOCUMENTS 114476 4/1990 Japan ..... 439/620
2-158070 6/1990 Japan .
216783 8/1990 Japan ..... 439/620

*Primary Examiner*—Gary F. Paumen
*Attorney, Agent, or Firm*—Timothy J. Aberle

[57] ABSTRACT

An electrical connector with electronic noise filtering structure is disclosed. Two slits (42) are formed in metal plate (40), which plate is secured on the rear of the electrical connector with through condenser (2). Slits (42) are formed to be at right angles to the longitudinal direction of the metal plate. The width of slits (42) expands or contracts in response to the housing's expansion or contraction due to temperature, and metal plate (40) adapts and prevents stress from accumulating in the through condenser solder section.

12 Claims, 8 Drawing Sheets

ELECTRICAL CONNECTOR WITH THROUGH CONDENSER

FIELD OF USE

The instant invention relates to an electrical connector with a through condenser for eliminating electronic noise.

BACKGROUND OF THE INVENTION

Recently the acceleration of transmission signals in electronic devices has created various types of noise. Electronic noise invades electronic devices and creates negative effects such as erroneous circuit operations; consequently, through condensers are generally used to eliminate electronic noise. One example is the connector with through condenser disclosed in the specification of Japanese Utility Model 59-27022 and shown in FIG. 8. Through condenser 100 of the conventional electrical connector with through condenser is soldered to metal plate 102. Metal plate 102 is secured to insulating housing 104, which is formed of plastic. Terminal 106 is soldered to through condenser 100 and is secured to housing 104.

However, in a high-temperature environment, elongation of housing 104, which usually has a larger coefficient of thermal expansion than metal plate 102, creates a discrepancy in the dimensions in this type of connector mounting. This results in problems such as tension and cracks occurring in the soldered sections, or the through condenser itself breaking.

Through condensers are generally soldered to a metal ground plate and then assembled in a housing. In such a case a jig is needed to push and position the through condensers in the metal ground plate before soldering. Another method, disclosed in the specification of Unexamined Japanese Utility Model 4-25176, is to temporarily hold the through condensers in one unit by means of a spring (burring) extended from the metal ground plate into the through condenser insertion hole. In such a case, however, the through condenser may be damaged or split when pressed in. There is also the problem of the through condenser being shaved down and creating particles.

The instant invention has the object of presenting an electrical connector with a through condenser which solves the above-noted defects of the conventional electrical connector with through condenser.

SUMMARY OF THE INVENTION

The instant invention's electrical connector with through condenser has multiple through condenser through-holes in a metal ground plate, and multiple terminals passing through terminal holes in an insulating housing, and is further characterized by forming at least one slit or slot in the metal ground plate between the adjacent through condensers but in a direction nearly at right angles to the longitudinal direction.

The instant invention further contemplates an electrical connector with through condensers which are condensers connected to a metal ground plate and into which terminals are inserted. The instant invention is characterized by sandwhiching at least part of the through condenser between the metal ground plate and the housing securing the metal ground plate, or between the metal ground plate and an interposing object between the housing.

DETAILED DESCRIPTION OF THE INVENTION

Figure 1:
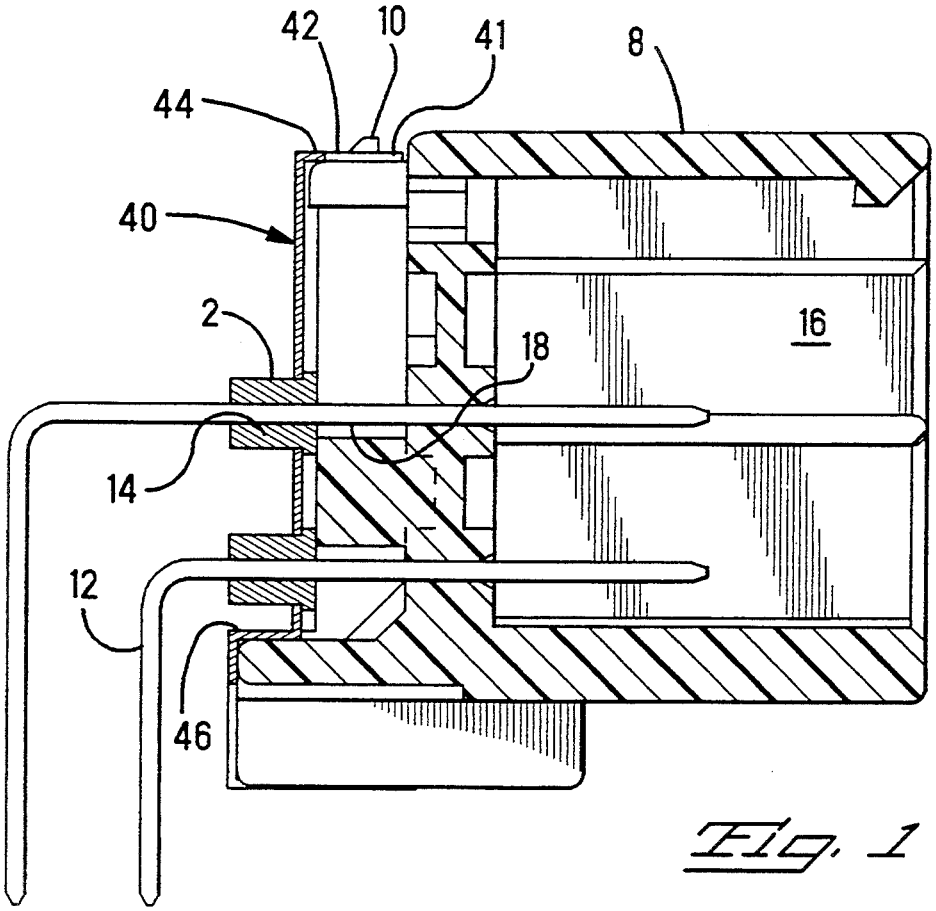
FIG. 1 is a vertical section view of the instant invention's electrical connector with through condenser.

FIGS. 1 through 7 show the first embodiment of an electrical connector with through condenser (hereafter referred to simply as "connector") according to the instant invention. FIG. 1 is a vertical section of the connector at line 9—9 in FIG. 2. In FIG. 1, through condenser 2 is soldered to metal plate 40. Metal plate 40 (a metal ground plate) is locked on projection 10 by latch 41, and the lower end and housing 8 are screwed together to a base plate (not shown in the Figure). Terminal 12 is inserted into through hole 14 and passes through the center of through condenser 2, and is further pressed and held in terminal hole 18. Terminal 12 is secured to through condenser 2 by soldering. The end of terminal 12 projecting from connector 1 is bent toward the base plate side and soldered into a base plate hole (not shown in the Figure). The end of terminal 12 projecting into the hollow in connector 1 is the contact point connecting with the other terminal.

Figure 2:
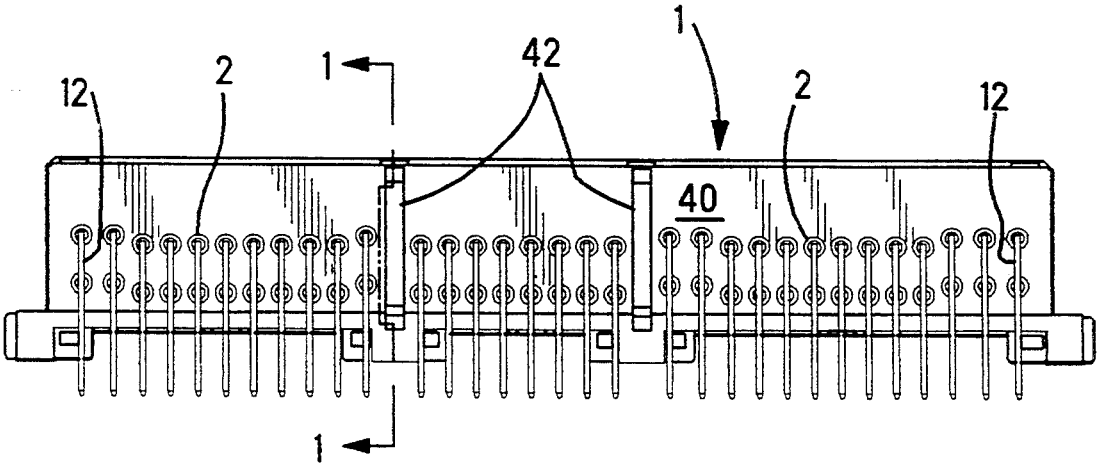
FIG. 2 is a rear view of FIG. 1's electrical connector with through condenser.

FIG. 2 shows the rear side of connector 1. Slits comprising gaps or slots 42 (hereafter referred to as slits) at right angles to the longitudinal direction are formed at two places in the central part of the longitudinal direction of metal plate 40. In this embodiment metal plate 40 has bent units 44 and 46 at the top and bottom, and slits 42 each extend into bent units 44 and 46 but are not open at the edges of metal plate 40. Metal plate 40 should be an electromagnetic barrier plate covering housing 8. If the slit 42 openings are small, metal plate 40 will not lose its effectiveness as an electromagnetic barrier plate.

Figure 3:
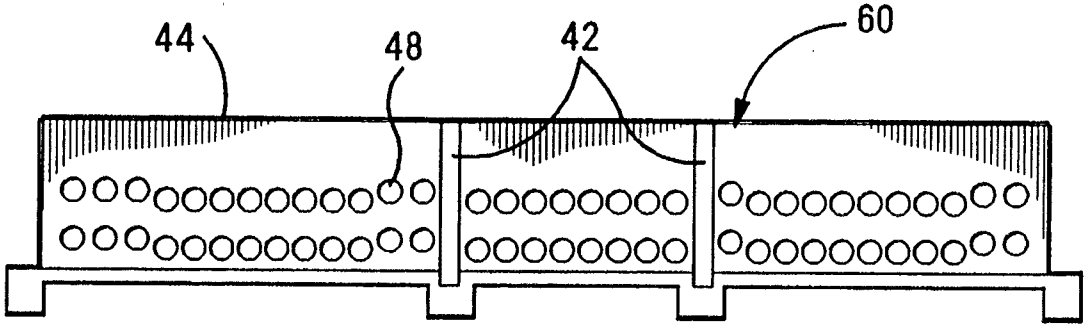
FIG. 3 is a front view of the second embodiment's metal plate.
Figure 4:
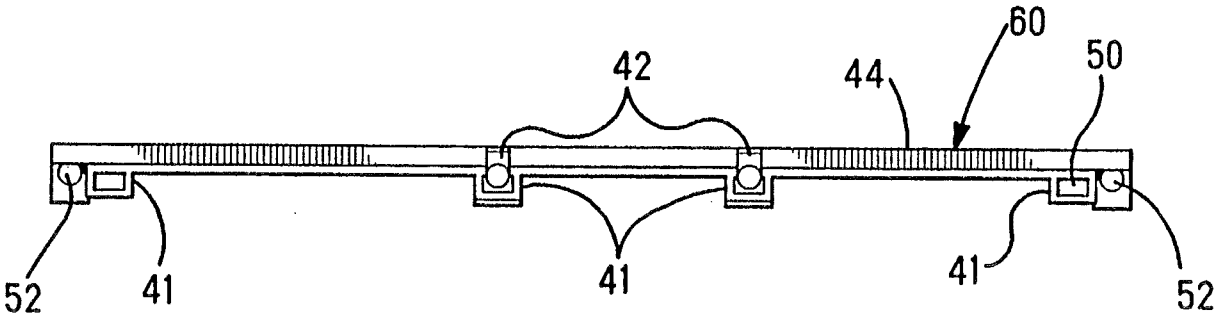
FIG. 4 is a top view of FIG. 3's metal plate.
Figure 7:
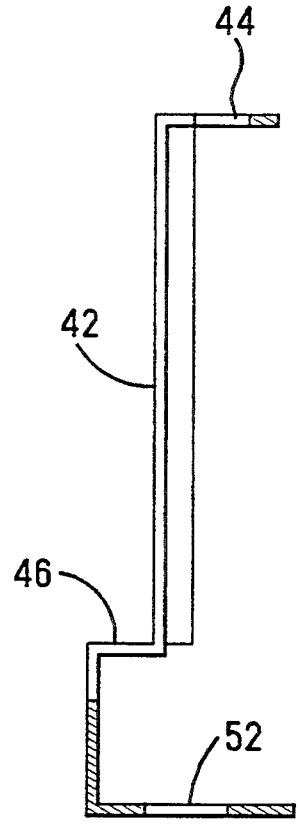
FIG. 7 is a magnified side section view of FIG. 3's metal plate.
Figure 8:
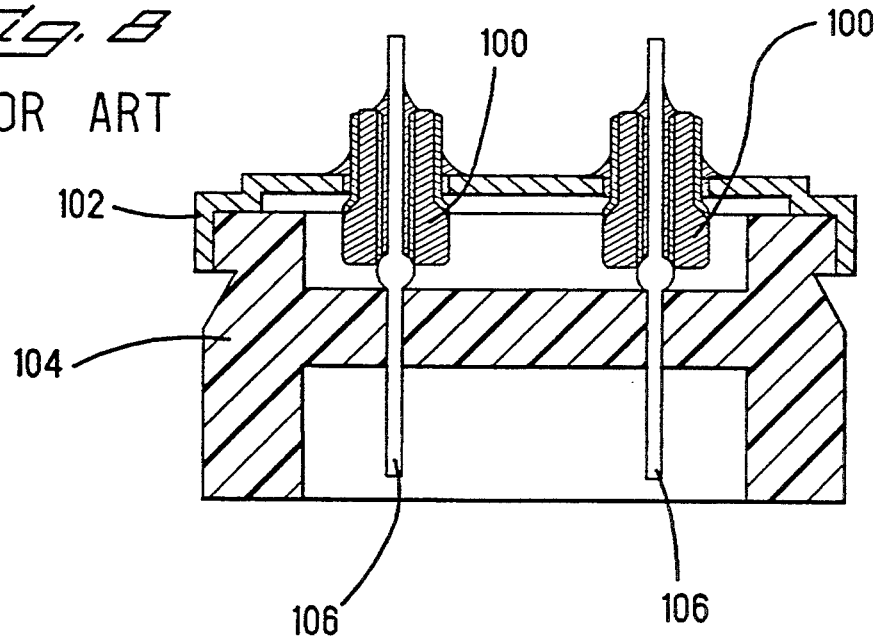
Fig. 8 PRIOR ART
FIG. 8 is a cross-sectional view of the prior art.

FIGS. 3, 4, and 7 show metal plate 60 in a second embodiment which has a shape that resembles the first embodiment. FIG. 3 is a frontal view of metal plate 60 seen from the connector 1 side. FIG. 4 is a top view of metal plate 60. The same reference numerals indicate the same parts as in the first embodiment. In the Figures, 48 indicates the hole where through condenser 2 is inserted and held. The upper and lower ends of metal plate 60 conform to the shape of housing 8 and are bent as shown in the magnified side section of FIG. 7. As in the first embodiment, slits 42 extend into upper and lower bent units 44 and 46, as shown in FIGS. 4 and 7. The openings of slits 42 in the first and second embodiments widen or narrow to match the expansion or contraction of housing 8. As a result, metal plates 40 and 60 can follow the expansion or contraction of housing 8, which prevents excessive tension from occurring through condenser 2's solder unit or in the through condenser itself.

Angular hole 50 is formed in latch 41 shown in FIG. 4. Metal plates 40 and 60 engage projection 10 inside angular hole 50 and are locked to housing 8. The round hole indicated by 52 in the Figure is a screw hole for securing metal plates 40 or 60 to housing 8.

Figure 5:
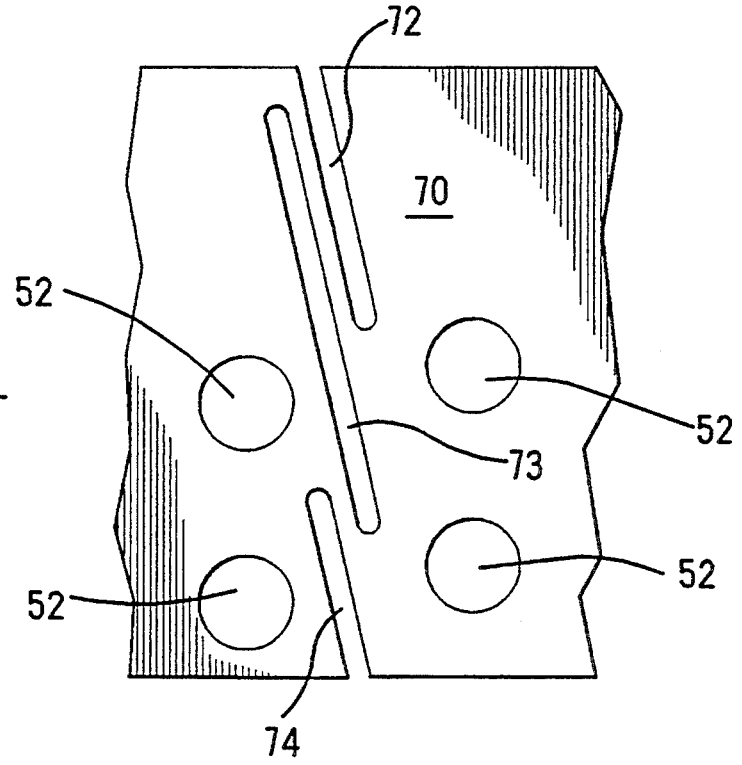
FIG. 5 is a partially magnified view of the third embodiment's metal plate.
Figure 6:
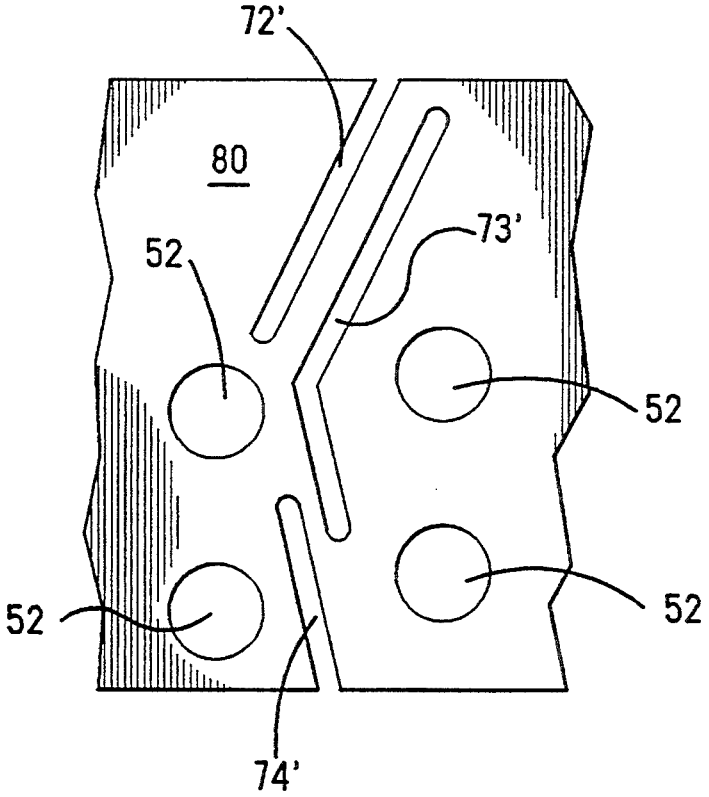
FIG. 6 is a partially magnified view of the fourth embodiment's metal plate.

FIGS. 5 and 6 show the third and fourth embodiments of metal plates 70 and 80. Three slits 72, 73, and 74 are formed in metal plate 70 in the third embodiment shown in FIG. 5; they slant in the same direction and are parallel to each other but are arranged in staggered positions. Slit 72 and slit 74 each open into the upper and lower ends of metal plate 70. Slit 73 is between slits 72 and 74 and both ends are closed.

Slits 72', 73', and 74' are formed in different directions on metal plate 80 in FIG. 6. Slits 72' and 74' are arranged in different directions and open onto the edges of metal plate 80. Slit 73' is formed to extend parallel to slits 72' and 74' and to be continuous in the center.

The three slits are divided into 72, 73, 74, and 72', 73', 74', but in both cases extend at right-angles to the longitudinal direction. In this way the metal plate's slit opening widens and can follow the expansion of housing 8. In particular, forming slits open at the edges of metal plates 70 and 80 provides more responsiveness to expansion and contraction than in the first and second embodiments. Additionally, the three slits 72, 73, 74, and 72', 73', 74', each comprise at least one edge portion which is arcuate, as is best shown in FIGS. 5 and 6.

The instant invention describes cases in which the number of slits is 2 or 3, but is not limited to the instant number. The shape can also be modified as necessary. The number of sites where they are located can also vary according to the connector shape and size.

The instant invention provides the following effects by providing slits in the metal plate holding a through condenser with terminals inserted and secured. Namely, even if the housing expands due to high temperature, the metal plate's slits widen and can follow expansion of the housing. This prevents cracks from appearing in the through condenser solder section or can prevent damage to the through condenser itself. At low temperatures the slit width narrows in response to housing contraction so the same sort of effect can be obtained. When the housing is slender, providing slits at right angles to the longitudinal direction produces an even more advantageous effect.

Figure 9:
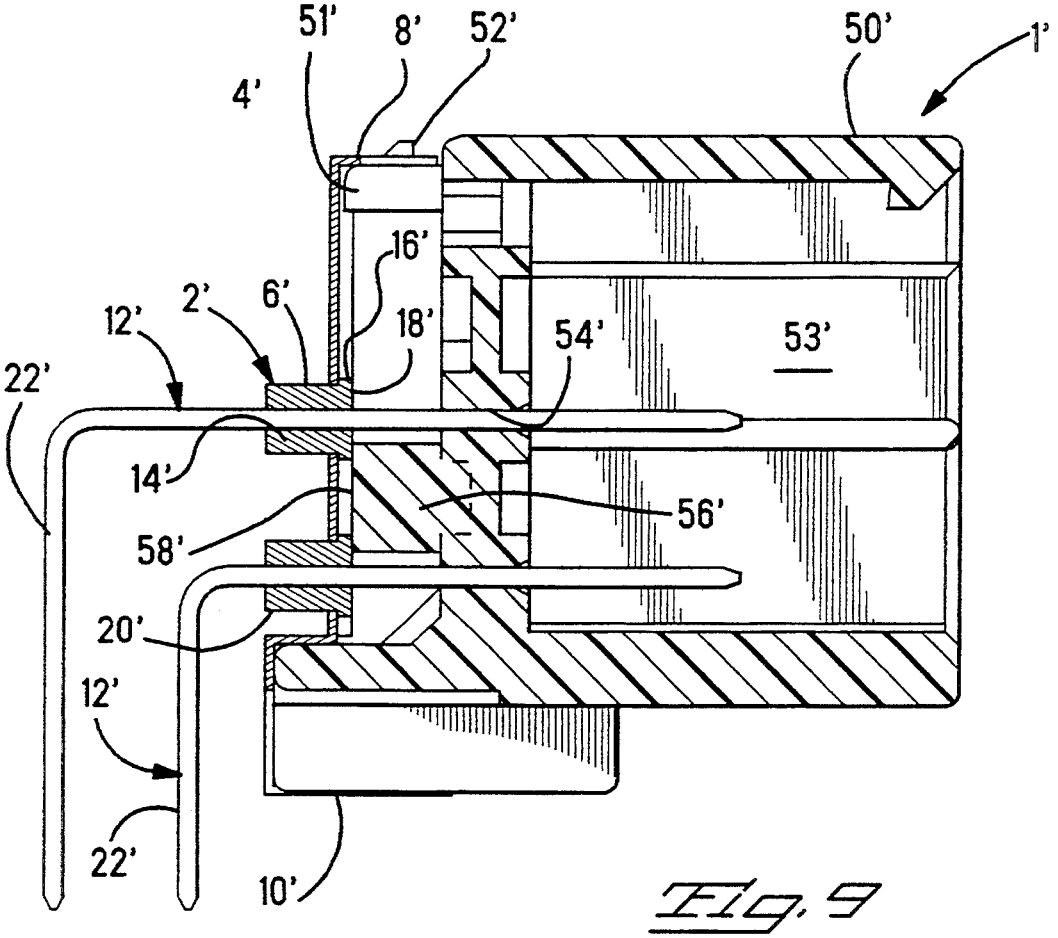
FIG. 9 is a vertical section view showing section 9—9 of the electrical connector with the through condenser in the instant invention's first embodiment shown in FIG. 10.

Next, other embodiments of the instant invention are explained in detail with reference to FIGS. 9 through 13. FIGS. 9 through 12 show the first embodiment of an electrical connector with through condenser (hereafter referred to simply as "connector") according to the instant invention. FIG. 9 is a vertical, sectional view along line 9—9 in FIG. 10. In FIG. 9, through condenser 2' is soldered in hole 6' of metal ground plate 4'. Latch 8' on the upper part of metal ground plate 4' engages with projection 52' provided on projecting unit 51' on housing 50' and secures it to the electrical connector with through condenser 1'. Lower unit 10' is screwed by a commonly known method (not shown in the Figure) together with housing 50' to a circuit board (not shown in the Figure). Housing 50' is formed from an insulating material such as plastic. Terminal 12' is inserted into and passes through hole 14', and is soldered to through condenser 2' and is pressed and held in terminal hole 54'. The part of terminal 12' projecting into hollow 53', which receives the other connector, is the contact point with the other terminal (not shown in the Figure). Multiple projecting units (ribs 56') are formed between the two rows of through condensers 2' on the back of housing 50'. Rear surface 58' makes contact with flat surface 18', which forms flange 16' on through condenser 2'. When connector 1' is assembled the rear surface 58' presses through condenser 2' and prevents through condenser 2' from falling out of hole 6' before soldering.

In assembling connector 1', through condensers 2' are inserted into each hole 6' in metal ground plate 4', which is held almost horizontally. The diameter of hole 6' is selected to be slightly larger than the diameter of the through condenser cylindrical unit so that it can easily be inserted without pressing. Housing 50' is designed so that terminal 12' is inserted into and held in terminal hole 54' as a subassembly. At this point rear unit 22' has not yet been bent and terminal 12' is straight. Next, the terminal 12' subassembly is positioned in through hole 14' from the top of metal ground plate 4' with through condenser 2' inserted, and is then inserted and assembled. At this time angular hole 24' in latch 8' of metal ground plate 4' engages with projection 52' on housing 50' and holds it. The rear surface 58' makes contact with flat surface 18' on through condenser 2' and presses through condenser 2' into the desired location and holds it. Then rear unit 22' is bent toward the mounting circuit board. The part of connector 1' behind metal ground plate 4' is immersed in the solder tank, and through condenser 2' and metal ground plate 4' are soldered, and through condenser 2' and terminal 12' are also soldered at the same time.

Figure 10:
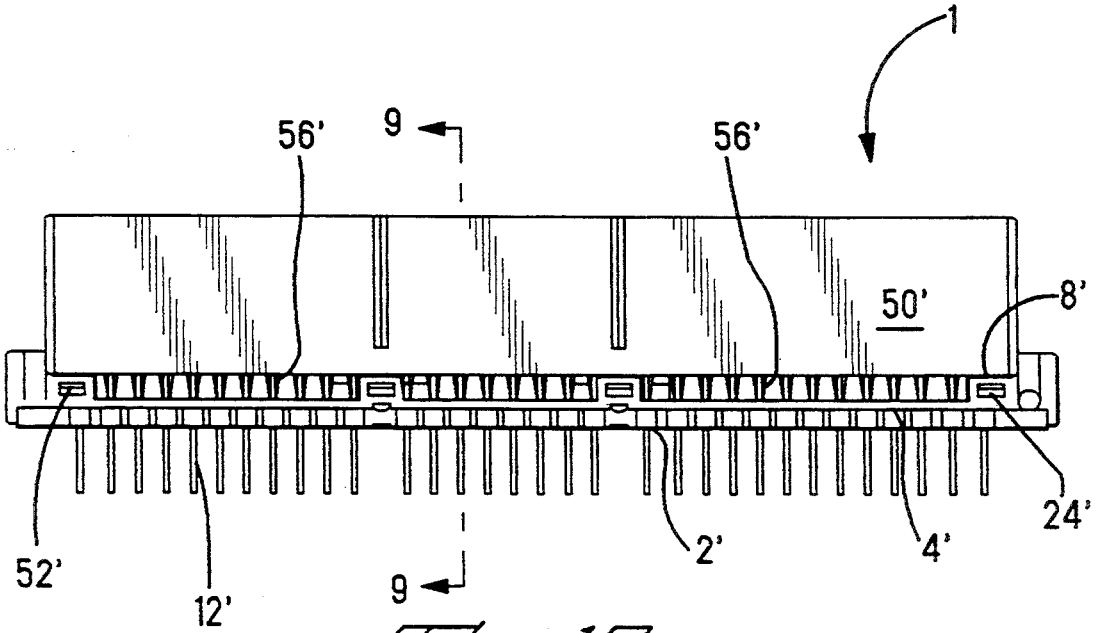
FIG. 10 is a rear view of a further embodiment of an electrical connector with a through condenser according to the instant invention.

FIG. 10 is a plane view of connector 1' in FIG. 9. FIG. 10 shows ribs 56' positioned to correspond to each terminal 12'.

Figure 11:
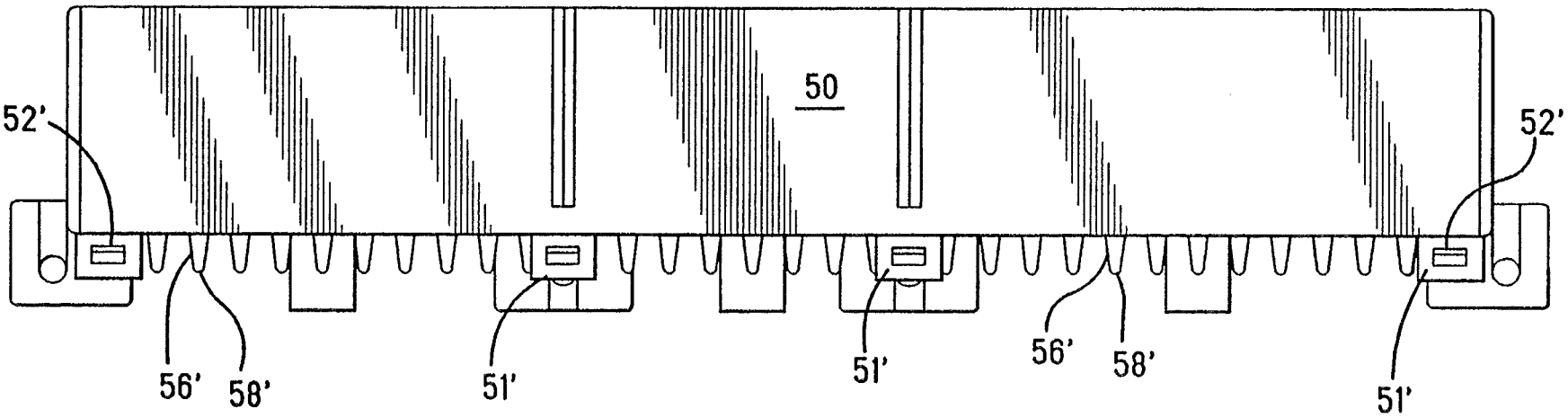
FIG. 11 is a plane view of the housing of FIG. 9.
Figure 12:
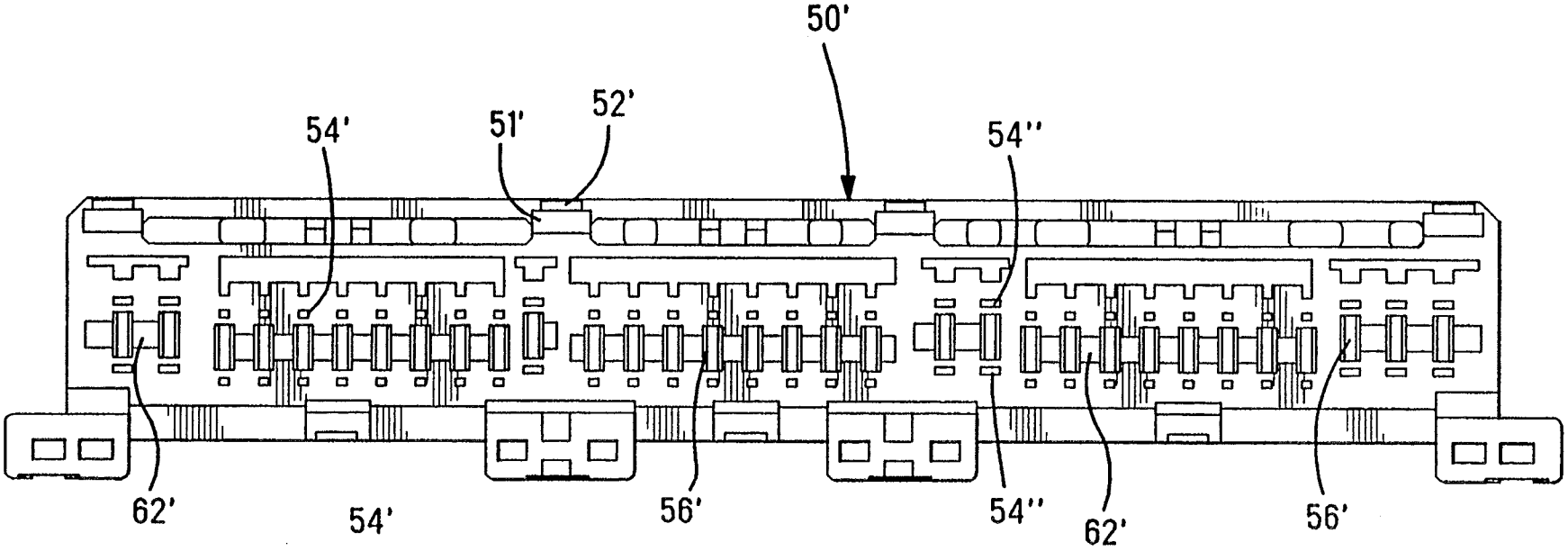
FIG. 12 is a view of FIG. 1's electrical connector housing.

FIGS. 11 and 12 show plane and rear views of housing 50' only. In FIG. 9, rear surface 58' is curved, and its tip makes contact with flat surface 18'. The tip can be any shape, but due to the strength of rib 56' and metal-forming pointed shapes, a thick shape as in this embodiment is appropriate.

FIG. 12 shows a vertical alignment of ribs 56, and shows ribs 56' arranged between terminal holes 54' and 54'' which are in two rows Ribs 56' are positioned to correspond to the positions of terminal holes 54' and 54''. In FIG. 12, 62' indicates a groove cut in housing 50'.

Figure 13:
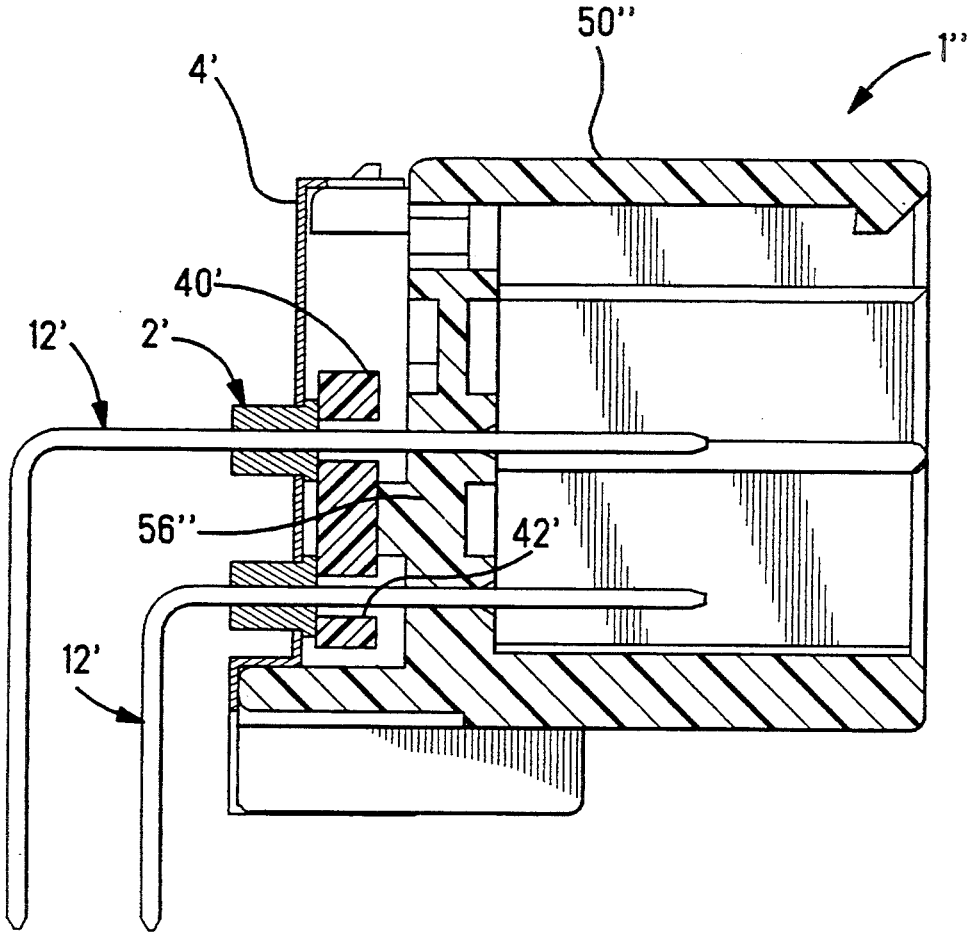
FIG. 13 is a vertical section view of the instant invention's second embodiment of an electrical connector with a through condenser.

FIG. 13 shows the electrical connector with through condenser 1'', which is a further embodiment of the instant invention. In this embodiment ferrite plate 40'' for electronic noise elimination is incorporated between through condenser 2' and housing 50''. Through condenser 2' is pressed and held against metal ground plate 4' by means of ferrite plate 40'' between ribs 56'' of housing 50'' and through condenser 2'. The embodiment in FIG. 13 is designed so that through condenser 2' and ferrite plate 40' are sandwhiched between metal ground plate 4' and housing 50''.

In both of the embodiments of connector 1' in the instant invention's ribs 56' and 56'' were arranged between two rows of through condensers, but it is not limited to this embodiment. They may be designed to press flat surface 18' at multiple sites around the circumference of through hole 14'.

The instant invention's electrical connector with through condenser produces the following advantages by sandwiching at least part of a through condenser between the metal ground plate and housing, or between the metal ground plate and an interposing object between the housing. Namely, the through condenser is held inside the connector before soldering, and a jig for supporting the through condenser at the desired location is not required. Furthermore, the sort of through condenser damage seen with burrings does not occur, and consequently there is no shaving down or chipping due to burrings. Thus the manufacturing processes can be reduced and made simple and cheap simply by providing holes for through condensers in the metal ground plate.

I claim:

1. An electrical connector for receiving a plurality of electrical terminals, comprising:

a dielectric housing with a plurality of electrical terminals which pass through rows of condensers;

said condensers are disposed in a ground plate having a longitudinal axis, the ground plate being disposed on the housing;

wherein the ground plate has at least one slit comprising an elongate which extends between said condensers in a direction generally transverse to said longitudinal axis, said gap not having a condenser therein;

whereby a width of said gap expands and contracts to accommodate expansion and contraction of the housing.

2. The electrical connector of claim 1, wherein the housing includes a rearwardly directed rib between the rows of condensers for spacing the ground plate from the housing.

3. The electrical connector of claim 1, wherein a plurality of said slits is provided on the ground plate.

4. The electrical connector of claim 2, wherein an edge of the rib engages an edge of a respective said condenser.

5. An electrical connector for receiving a plurality of electrical terminals, comprising:

a dielectric housing with a plurality of electrical terminals which pass through rows of condensers;

said condensers are disposed in a generally planar ground plate having a axis, the ground plate being disposed on the housing; and wherein the ground plate has at least one slit comprising an elongate which extends between said condensers in a first gap direction which is disposed at an angle relative to said axis, said gap not having a condenser therein;

whereby a width of said gap expands and contracts in the plane of said ground plate to accommodate expansion and contraction of the housing.

6. The electrical connector of claim 5, wherein the gap of said slit adjoins a side edge of said ground plate.

7. The electrical connector of claim 5, wherein said ground plate includes a second gap formed therein having a second gap direction.

8. The electrical connector of claim 7, wherein said first and second gap directions are generally parallel.

9. The electrical connector of claim 7, wherein said first and second directions are generally non-parallel.

10. The electrical connector of claim 5, wherein said ground plate comprises edges forming said gap.

11. The electrical connector of claim 10, wherein said edges forming said gap are free edges.

12. The electrical connector of claim 10, wherein said edges forming said gap comprise an arcuate edge section in the plane of said ground plate.

* * * * *

UNITED STATES PATENT AND TRADEMARK OFFICE

CERTIFICATE OF CORRECTION

PATENT NO. : 5,441,425

DATED : August 15, 1995

INVENTOR(S) : Hiroshi Katamura

It is certified that error appears in the above-indentified patent and that said Letters Patent is hereby corrected as shown below:

Col. 5, line 31 and col. 6, line 16,
Claim 1, line 9 and Claim 5, line 9: after "elongate" insert --gap--.

Signed and Sealed this

Twelfth Day of December, 1995

*Attest:*

*Attesting Officer*

BRUCE LEHMAN

*Commissioner of Patents and Trademarks*